US007350900B2

(12) United States Patent
Baumer

(10) Patent No.: US 7,350,900 B2
(45) Date of Patent: Apr. 1, 2008

(54) TOP FEED DROPLET GENERATOR

(76) Inventor: Michael F. Baumer, c/o Kodak Versamark, Inc., 3000 Research Blvd., Dayton, OH (US) 45420

( * ) Notice: Subject to any disclaimer, the term of this patent is extended or adjusted under 35 U.S.C. 154(b) by 390 days.

(21) Appl. No.: 11/079,656

(22) Filed: Mar. 14, 2005

(65) Prior Publication Data

US 2006/0203046 A1 Sep. 14, 2006

(51) Int. Cl.
*B41J 2/155* (2006.01)
*B41J 2/05* (2006.01)
*B41J 2/175* (2006.01)

(52) U.S. Cl. ..... 347/42; 347/65; 347/85

(58) Field of Classification Search ..... 347/20, 347/42, 43, 54, 75, 85, 65
See application file for complete search history.

(56) References Cited

U.S. PATENT DOCUMENTS 3,714,928 A 2/1973 Taylor
4,015,271 A 3/1977 Sultan
4,223,320 A 9/1980 Paranjpe
4,417,251 A 11/1983 Sugitani
4,468,680 A 8/1984 Martner
4,528,575 A 7/1985 Matsuda
4,752,787 A 6/1988 Matsumoto
4,937,597 A 6/1990 Yasuhara
5,121,141 A 6/1992 Hadimoglu
5,220,345 A 6/1993 Hirosawa
5,389,962 A 2/1995 Sekiya
5,450,110 A 9/1995 Sato
5,856,838 A 1/1999 Oda
5,975,681 A 11/1999 Ogasawara

FOREIGN PATENT DOCUMENTS

JP 02155742 A * 6/1990 ..... 347/75

* cited by examiner

*Primary Examiner*—Shih-Wen Hsieh
(74) *Attorney, Agent, or Firm*—The Buskop Law Group, P.C.

(57) ABSTRACT

An ink jet droplet generator body for an ink jet droplet generator comprising an orifice plate with a plurality of nozzles forming a jet array entails a throughbore with an entrance and exit port, the throughbore provides a path through that flows fluid from a fluid supply to the first slot. The first slot connects the throughbore to the orifice plate. One or more holes or a slot are located in the top of the generator body to direct fluid or a secondary source of fluid to the first slot and then the orifice plate.

24 Claims, 4 Drawing Sheets

TOP FEED DROPLET GENERATOR

FIELD OF THE INVENTION

The present embodiments relate generally to an improved droplet generator for ink jet printer.

BACKGROUND OF THE INVENTION

The overall thickness and height of continuous inkjet droplet generators must decrease to enable the frequency of droplet formation to increase. To further increase the droplet generation rates, the diameter of the bore through the droplet generator must decrease as well. This decrease conflicts with the need for increased amounts of ink flow required at higher frequencies. Turbulence occurs in the smaller through bores and affects the stimulation performance of the drop let generator. The turbulence problem also exists when attempting to fabricate a longer droplet generator with increased ink flow rates in order to supply the increased number of inkjets with a small through bore.

A need exists for an increased amount of ink flowing to the droplet generator and while using a small bore.

SUMMARY OF THE INVENTION

An ink jet droplet generator body for an ink jet droplet generator comprising an orifice plate with a plurality of nozzles forming a jet array entails a throughbore with an entrance and exit port, the throughbore provides a path through which fluid flows from a fluid supply to the first slot. The first slot connects the throughbore to the orifice plate. One or more holes or a slot are located in the top of the generator body to direct fluid or a secondary source of fluid to the first slot and then the orifice plate.

The present embodiments are advantageous over the prior art because the ink jet printer can be run at higher frequencies and with longer arrays for more throughput than known devices.

BRIEF DESCRIPTION OF THE DRAWINGS

In the detailed description of the preferred embodiments of the invention presented below, reference is made to the accompanying drawings, in which.

The present embodiments are detailed below with reference to the listed FIGS.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well-known to those skilled in the art.

Turbulence in the cavity section of ink jets occurs as attempts are made to increase flow rates for ink jets. Traditionally, turbulence has been reduced by making the droplet generators throughbore larger. The larger sizes of the bore diameter of the droplet generator array results in a lower operating frequency for the droplet generator, which in turn means lower speed of operation.

The present embodiments provide the benefit of smaller bore diameters with the benefit of increased speed without the turbulence usually encountered. The embodied ink jet droplet generator bodies permits higher frequency of operation for the droplet generator and longer droplet generators.

The embodied top feed droplet generator supplies ink to the droplet generator fluid cavity through a number of small fluid ports down the length of the array. The small ports are on the side opposite the jet array. The ports are small enough to not change the vibration pattern of the droplet generator. The small ports are connected to an external fluid supply plenum by flexible tubing. The tubing is acoustically dead and does not affect vibration of the droplet generator.

The fluid usable in this droplet generator includes ink, flush fluids, and replenishment fluid.

Figure 1:
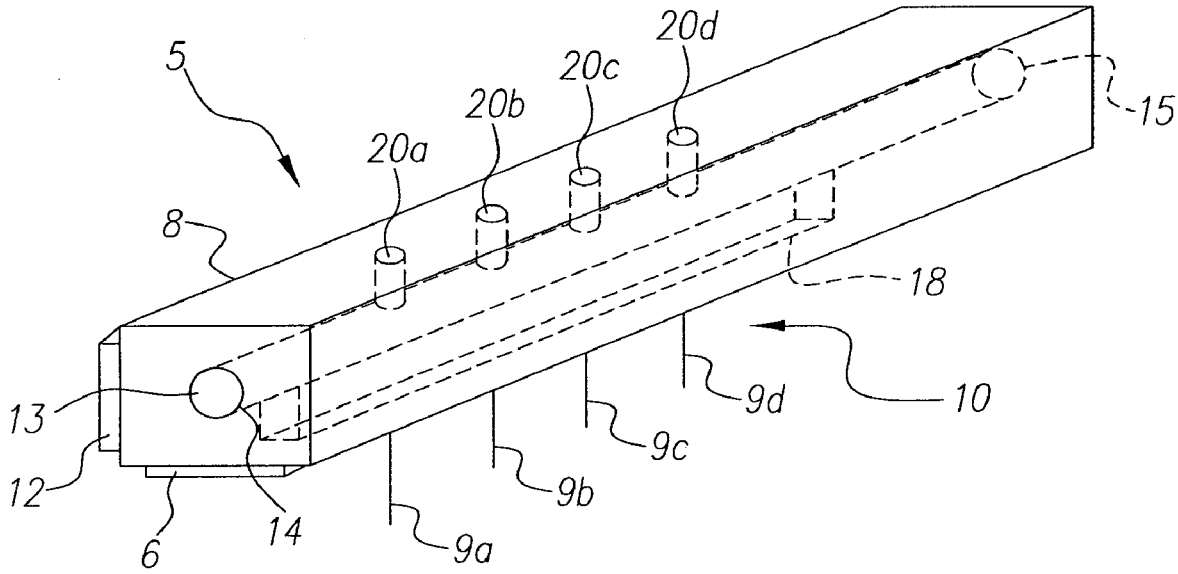
FIG. 1 depicts an isometric view of an embodiment of a droplet generator with discrete holes in the top.

With reference to the figures, FIG. 1 depicts an isometric view of an embodiment of a droplet generator 5 with discrete holes in the top. The ink jet droplet generator body 8 is for use with an ink jet droplet generator. A typical ink jet droplet generator includes an orifice plate 6 with a plurality of nozzles 9*a*, 9*b*, 9*c*, and 9*d* forming a jet array 10. FIG. 1 examples four nozzles 9*a*, 9*b*, 9*c*, and 9*d*, but a typical jet array 10 can include up to 600 holes per inch. The generator includes an actuator 12 adapted to stimulate the jet array 10.

The embodied generator body 8 includes a throughbore 13, a first slot 18, one or more discrete holes 20*a*, 20*b*, 20*c*, and 20*d*, and a seal. The throughbore 13 includes a first (fluid receiving) port 14 and a second (fluid returning) port 15. The generator body 8 can be composed of a metal, such as stainless steel or beryllium. The preferred metal for the generator body 8 is 17-4PH stainless steel.

Figure 2:
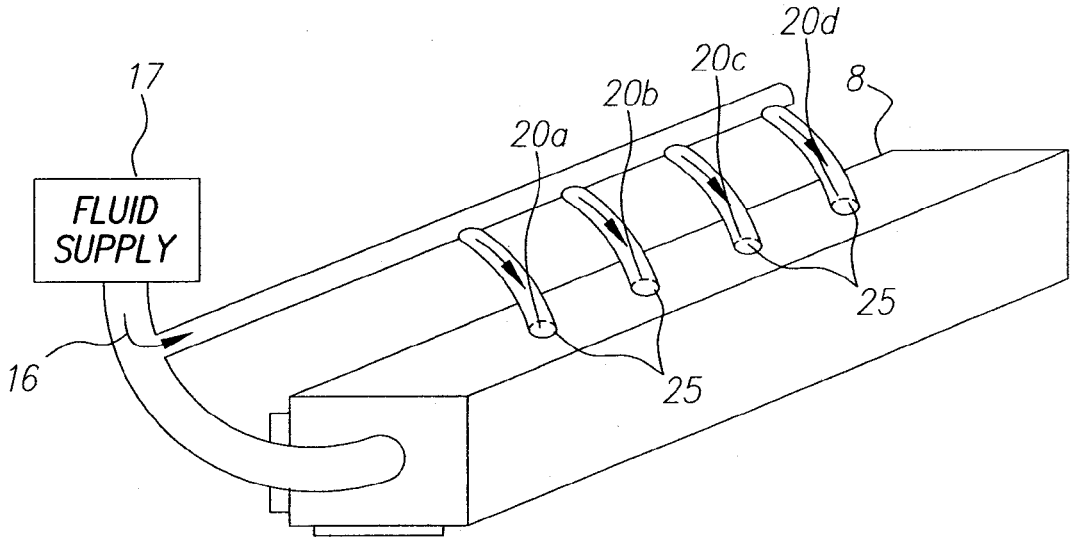
FIG. 2 depicts a perspective view FIG. 1 exampling the fluid flowing from the fluid supply to the droplet generator.

FIG. 2 depicts a perspective view of the generator body 5 exampled in FIG. 1. FIG. 2 more clearly shows the fluid 16 flowing from the fluid supply 17 into the first port 14 of the throughbore 13. The throughbore 13 allows the fluid 16 to reach the to the orifice plate 6 through the first slot 18.

Returning to FIG. 1, an embodiment of the generator body 8 includes one or more discrete holes 20*a*, 20*b*, 20*c*, and 20*d* disposed in the top of the generator body 8. FIG. 1 and FIG. 2 example four discrete holes. The discrete holes 20*a*, 20*b*, 20*c*, and 20*d* receive additional fluid from the fluid supply 17 and communicate the additional fluid to the throughbore 13 and then to the orifice plate 6. Each discrete hole 20*a*, 20*b*, 20*c*, and 20*d* typically has a diameter ranging from about 30 mils to about 120 mils. Each hole can vary in diameter. The holes are capable of supporting operating pressures up to 80 psi.

Figure 3:
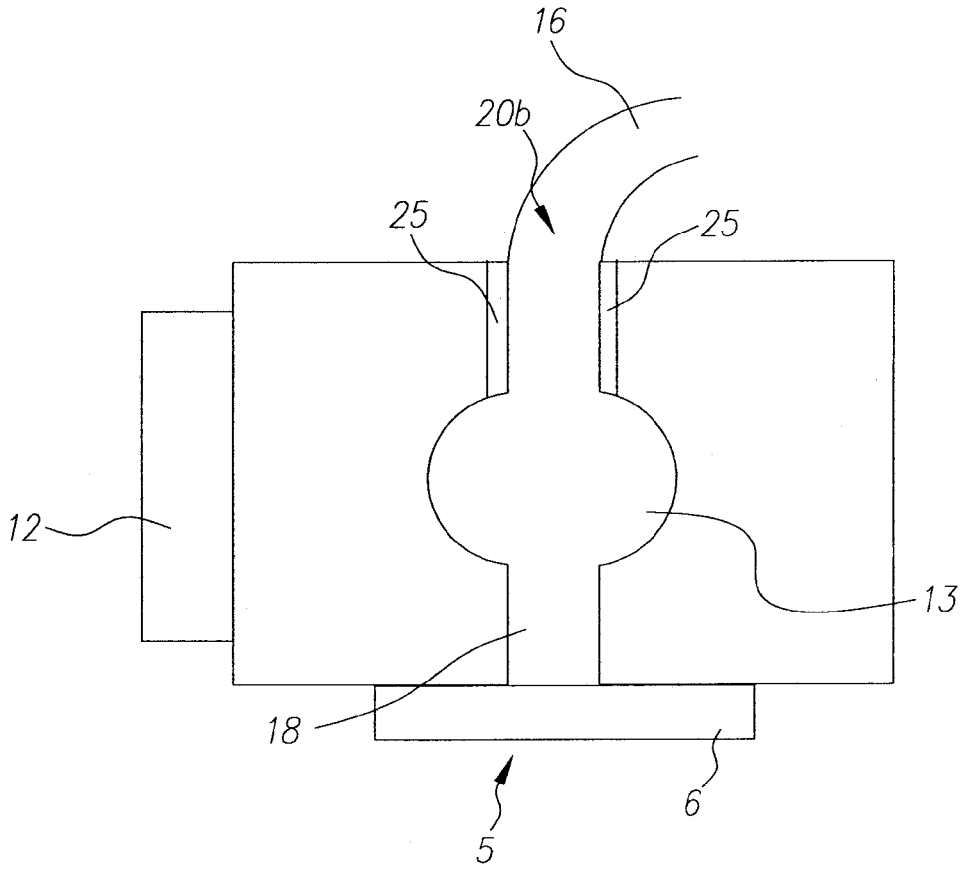
FIG. 3 depicts a cross section detail of the fluid supply to the droplet generator of FIG. 1 and FIG. 2.

FIG. 3 depicts a cross section detail of the fluid supply to the droplet generator 5 of FIG. 1 and FIG. 2. As shown in FIG. 3, the first slot 18 is vertically above the orifice plate 6. The fluid 16 can enter through the throughbore 13 to the first slot 18 and thence vertically below to the orifice plate 6. Fluid 16 or addition fluid can enter though the discrete hole 20*a* on top of the generator body 8 and can reach the orifice plate though the throughbore 13.

Figure 4:
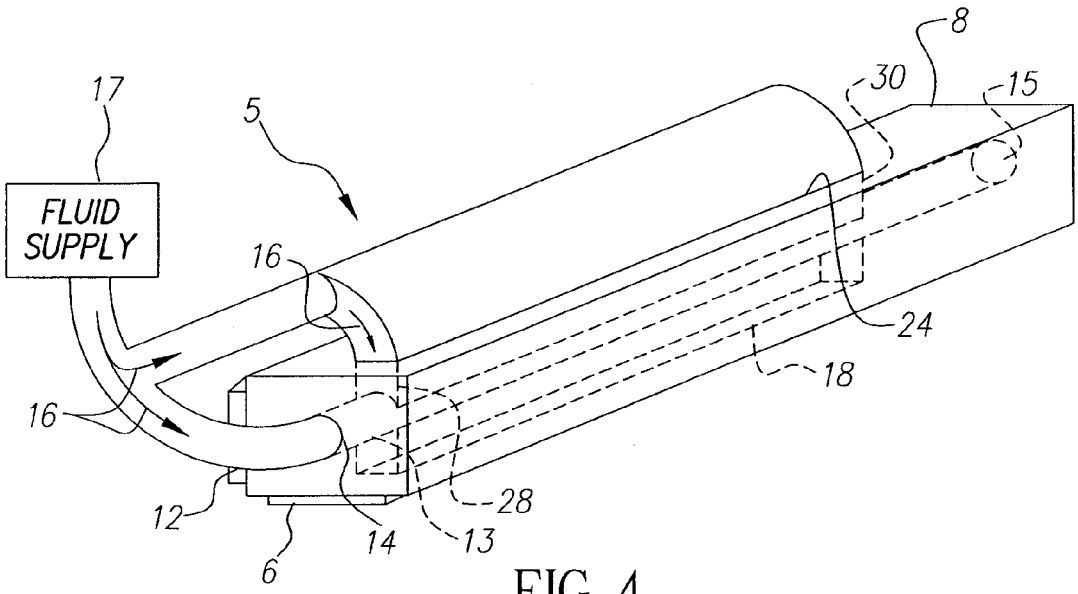
FIG. 4 depicts an isometric view of an alternate embodiment of the ink jet droplet generator using two slots with a throughbore.
Figure 5:
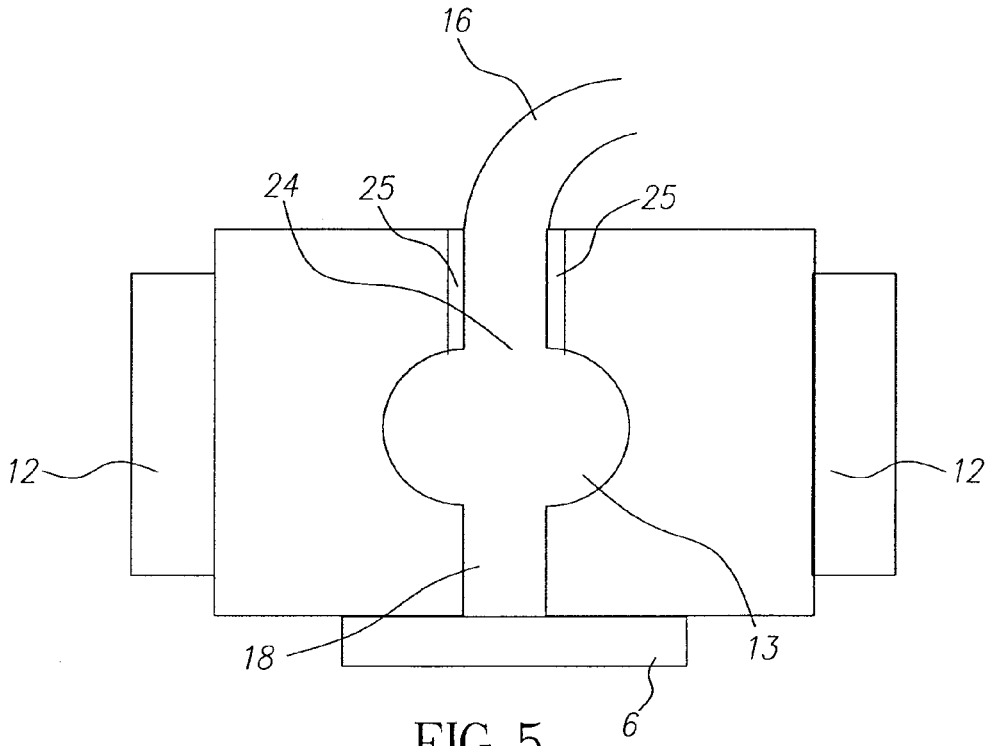
FIG. 5 depicts a cross section detail of the fluid supply to the droplet generator of FIG. 4.

In an alternative embodiment depicted in FIG. 4, a second slot 24 disposed in the generator body 8 vertically above the first slot 18 can be used to receive additional fluid from the fluid supply 17 and communicate the additional fluid to the throughbore 13. The second slot 24 is used in conjunction with the throughbore's inlet port 14, wherein both the inlet port 14 and the second slot 24 can provide fluid. A seal 25 can be disposed in the second slot 24. The seal 25 is adapted to provide an acoustic impedance mismatch to the generator body 8. FIG. 5 depicts a cross section detail of the fluid supply to the drop generator of FIG. 4.

Figure 6:
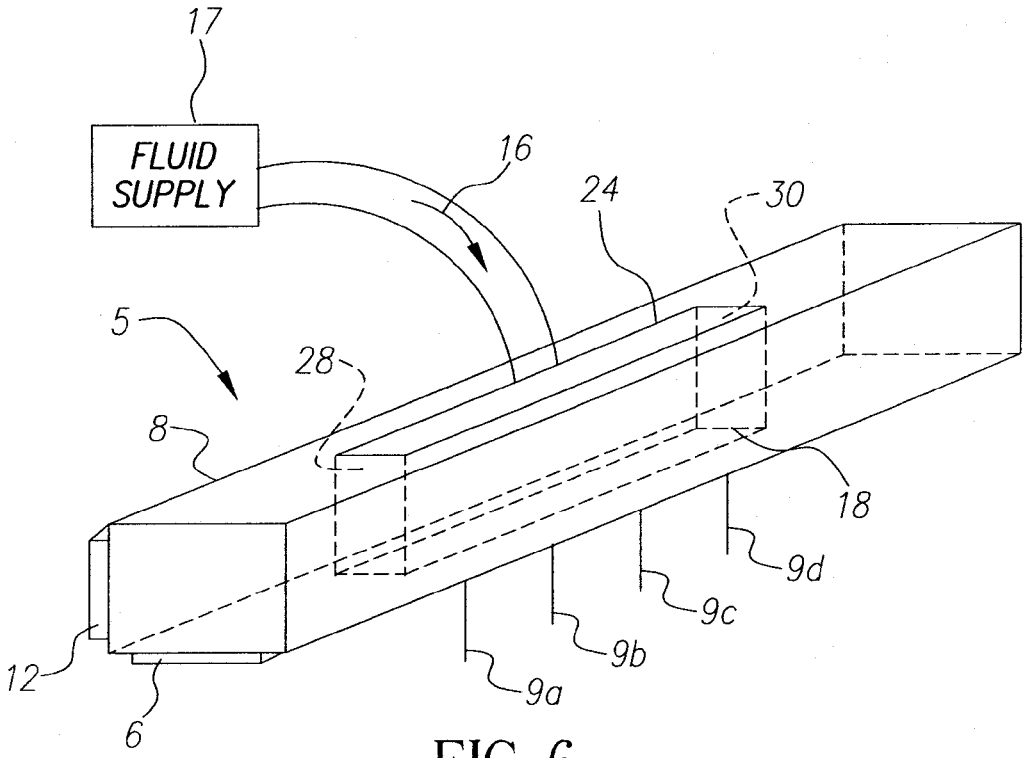
FIG. 6 depicts an isometric view of another embodiment of the ink jet droplet generator using two slots without a throughbore.
Figure 7:
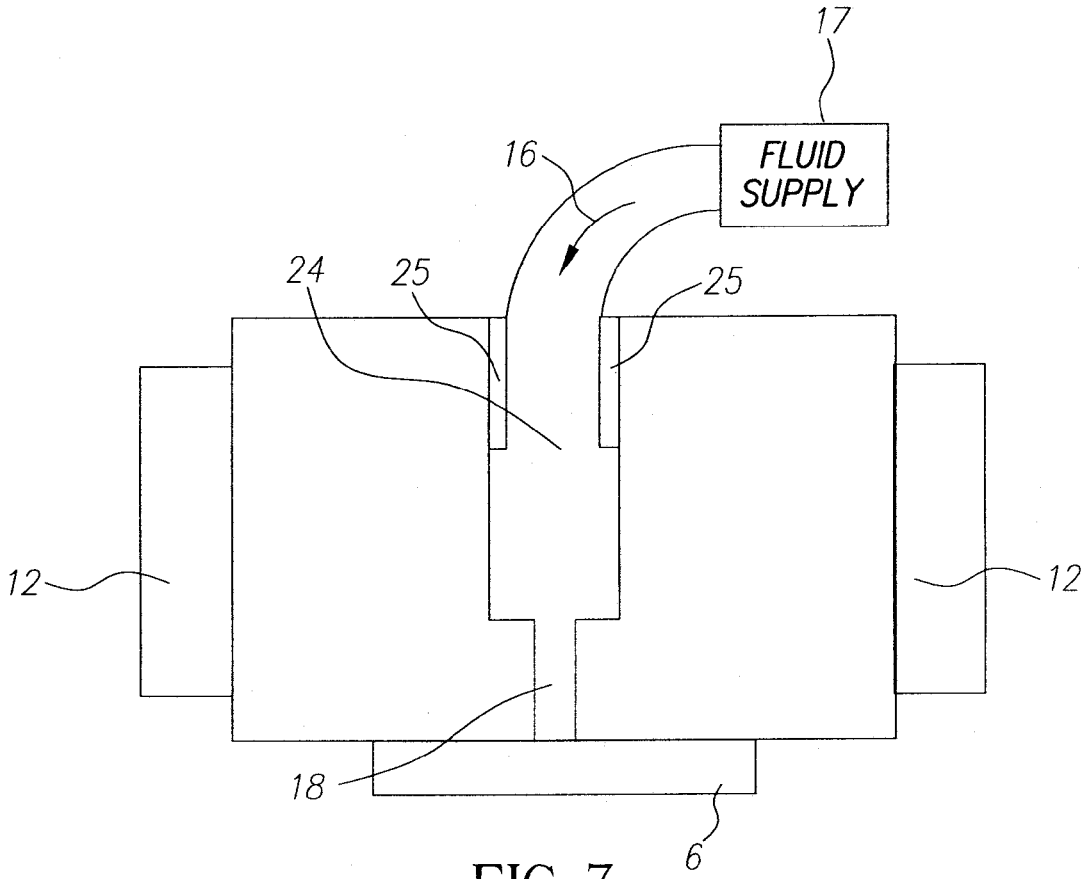
FIG. 7 depicts a cross section detail of the fluid supply to the droplet generator of FIG. 6.

In another alternative embodiment depicted in FIG. 6, a second slot 24 disposed in the generator body 8 vertically above the first slot 18 can be used to receive fluid from the fluid supply 17 and communicate the fluid to the first slot 18 and thence vertically below to the orifice plate 6. In this embodiment, the second slot 24 is the sole source of fluid into the droplet generator body 8. A seal 25 can be disposed in the second slot 24. The seal 25 is adapted to provide an acoustic impedance mismatch to the generator body 8. FIG. 7 depicts a cross section detail of the fluid supply to the drop generator of FIG. 6.

The length of the second slot 24 can be approximately the same length as the first slot 18 or longer than the first slot 18. The width of the second slot 24 is typically larger than the width of the first slot 18. The width of the second slot 24 can be from about 30 mils to about 120 mils. The second slot 24 can support operating pressures up to 80 psi.

The second slot 24 can include a first end wall 28 and a second end wall 30 located opposite one another. The end walls are sloped to converge toward the orifice plate 6, or instead may be parallel.

In an example of the method, small holes are drilled in the top of the droplet generator. Small 15-gage polypropylene tubes, typically EFD part number 5115PP-B, are bonded with epoxy into the holes. The polypropylene tubes connect the droplet generator to an external manifold for supplying ink. The normal droplet generator inlet and outlet are retained in order to facilitate cross-flushing the droplet generator for particle and air bubble removal.

The invention has been described in detail with particular reference to certain preferred embodiments thereof, but it will be understood that variations and modifications can be effected within the spirit and scope of the invention.

PARTS LIST

5. droplet generator
6. orifice plate
8. droplet generator body
9*a*. nozzles
9*b*. nozzles
9*c*. nozzles
9*d*. nozzles
10. jet array
12. actuator
13. throughbore
16. fluid
17. fluid supply
18. first slot
20*a*. discrete hole
20*b*. discrete hole
20*c*. discrete hole
20*d*. discrete hole
24. second slot
25. seal
28. first end wall
30. second end wall

The invention claimed is:

1. An ink jet droplet generator body (8) for an ink jet droplet generator (5) comprising an orifice plate (6) with a plurality of nozzles (9*a*, 9*b*, and 9*c*) forming a jet array (10), wherein the generator body (8)comprises:

a. a throughbore (13) comprising a first port and a second port, wherein the throughbore (13) is adapted to flow a fluid (16) from a fluid supply (17) to the orifice plate (6);

b. a first slot (18) disposed in the generator body (8) in communication with the throughbore (13), wherein the first slot (18) is adapted to flow the fluid (16) from the throughbore (13) to the orifice plate (6);

c. at least one discrete hole (20*a*, 20*b*, and 20*c*) disposed in the generator body (8) opposite the first slot (18), wherein the at least one discrete holes (20*a*, 20*b*, and 20*c*) is adapted to receive additional fluid from the fluid supply (17) and communicate the additional fluid to the throughbore (13); and d. a seal (25) disposed between the first slot (18) and the fluid supply (17).

2. The generator of claim 1, wherein the generator body comprises a metal.

3. The generator of claim 2, wherein the metal is stainless steel or beryllium.

4. The generator of claim 1, wherein each discrete hole comprises a diameter ranging from about 30 mils to about 120 mils.

5. The generator of claim 4, wherein the at least one discrete hole is a plurality of discrete holes that vary in diameter.

6. The generator of claim 1, wherein the at least one discrete hole is adapted to support an operating pressure up to 80 psi.

7. The generator of claim 1, wherein the seal is adapted to provide an acoustic impedance mismatch to the generator body.

8. An ink jet droplet generator body for an ink jet droplet generator comprising an orifice plate with a plurality of nozzles forming a jet array, wherein the generator body comprises:

a. a throughbore comprising a first port and a second port, wherein the throughbore is adapted to flow a fluid from a fluid supply to the orifice plate;

b. a first slot disposed in the generator body in communication with to the throughbore, wherein the first slot is adapted to flow the fluid from the throughbore to the orifice plate;

c. a second slot disposed in the generator body opposite the first slot, wherein the second slot is adapted to receive additional fluid from the fluid supply and communicate the additional fluid to the throughbore; and d. a seal disposed between the second slot and the fluid supply.

9. The generator of claim 8, wherein the second slot is approximately the same length as the first slot.

10. The generator of claim 8, where the second slot comprises a length longer than the first slot in order to reduce turbulence effect of the fluid flowing to the orifice plate from the throughbore.

11. The generator of claim 8, wherein the second slot comprises a width larger than that of the first slot.

12. The generator of claim 8, wherein the second slot comprises a width ranging from about 30 mils to about 120 mils.

13. The generator of claim 8, wherein the second slot is adapted to support an operating pressure up to 80 psi.

14. The generator of claim 8, wherein the second slot comprises a first wall and second wall opposite one another, wherein the walls are parallel.

15. The generator of claim 8, wherein the second slot comprises a first end wall and a second end wall opposite one another, wherein the end walls are sloped to converge toward the orifice plate.

16. The generator of claim 8, wherein the seal is adapted to provide an acoustic impedance mismatch to the generator body.

17. An ink jet droplet generator body for an ink jet droplet generator comprising an orifice plate with a plurality of nozzles forming a jet array, wherein the generator body comprises:

a. a first slot disposed in the generator body vertically above the orifice plate;

b. a second slot disposed in the generator body vertically above the first slot, wherein the second slot is in communication with the first slot and a fluid supply, and wherein a fluid flows from the second slot to the first slot and thence vertically below to the orifice plate; and c. a seal disposed between the second slot and the fluid supply.

18. The generator of claim 17, wherein the second slot is approximately the same length as the first slot.

19. The generator of claim 17, where the second slot comprises a length longer the first slot.

20. The generator of claim 17, wherein the second slot comprises a width larger than that of the first slot.

21. The generator of claim 17, wherein the second slot comprises a width ranging from about 30 mils to about 120 mils.

22. The generator of claim 17, wherein the second slot is adapted to support an operating pressure up to 80 psi.

23. An ink jet droplet generator body for an ink jet droplet generator comprising an orifice plate with a plurality of nozzles forming a jet array, wherein the generator body comprises:

a. a first slot disposed in the generator body;

b. a second slot disposed in the generator body opposite the first slot, wherein the second slot is in communication with the first slot and a fluid supply, and wherein a fluid flows from the second slot to the first slot; and c. a seal disposed between the second slot and the fluid supply, and wherein the second slot has a first end wall and a second end wall opposite one another and the end walls are sloped to converge toward the orifice plate.

24. The generator of claim 17, wherein the seal is adapted to provide an acoustic impedance mismatch to the generator body.

* * * * *